United States Patent [19]

Ghatak

[11] 4,416,087

[45] Nov. 22, 1983

[54] DOOR FRAME REINFORCER

[76] Inventor: Paritosh K. Ghatak, 510 Johnston Dr., Bethlehem, Pa. 18017

[21] Appl. No.: 306,690

[22] Filed: Sep. 29, 1981

[51] Int. Cl.[3] ..... E06B 1/04

[52] U.S. Cl. ..... 49/462; 49/504; 52/211; 52/514; 292/346

[58] Field of Search ..... 49/460, 462, 504; 292/346; 52/211, 514

[56] References Cited

U.S. PATENT DOCUMENTS

| | | | |
|---|---|---|---|
| 2,309,452 | 1/1943 | Hasenburger et al. | 49/504 |
| 3,888,530 | 6/1975 | Fabrici | 292/346 X |
| 3,918,207 | 11/1975 | Aliotta | 49/462 |
| 3,963,269 | 6/1976 | Rosenberg | 292/346 |
| 4,074,484 | 2/1978 | Queren | 49/504 X |

*Primary Examiner*—Philip C. Kannan

*Attorney, Agent, or Firm*—Ruth Moyerman

[57] ABSTRACT

A door jamb reinforcer is disclosed which comprises at least one, and preferably two or more, reinforcing rods which are positioned internally along the depth of a door jamb adjacent the area of the bolt receiver or striker plate. The rods are used in conjunction with a brace bar which is positioned adjacent the striker plate, and extends above and below it on the edge of the door jamb. With the use of the bar and reinforcing rods of this invention, a door jamb's shear and tensile strength is increased to prevent the jamb from being splintered and broken during a potential forced entry.

1 Claim, 6 Drawing Figures

PRIOR ART-A

PRIOR ART-B

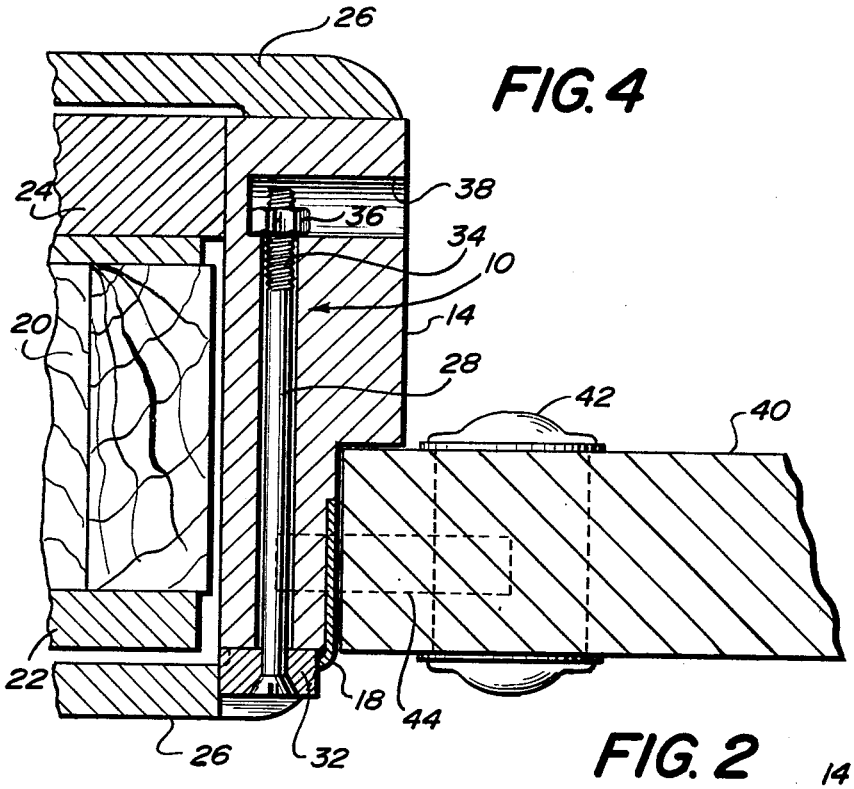
FIG. 4
FIG. 3
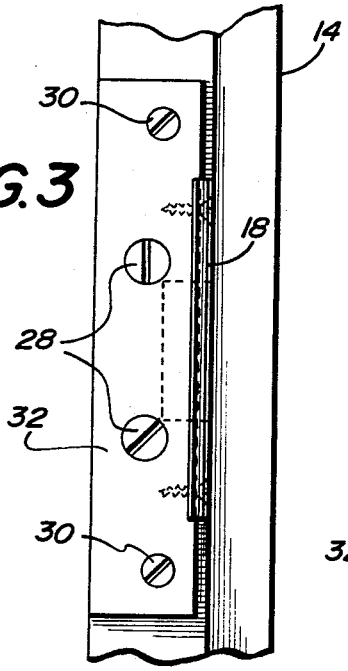
FIG. 2
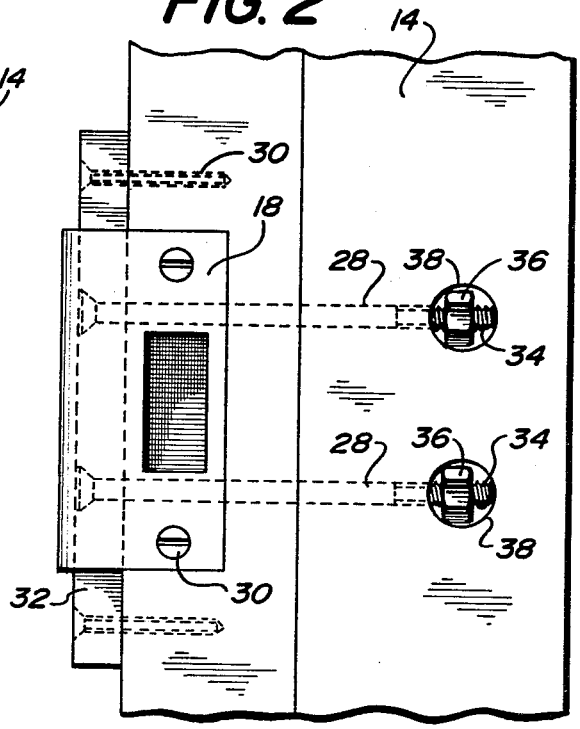

DOOR FRAME REINFORCER

BACKGROUND OF THE INVENTION

1. Field of the Invention

This invention relates to static structures and more particularly to resilient strip forming portal opening through barrier.

2. Description of the Prior Art

The need to protect the doors of buildings from unauthorized tampering is a perennial problem for which many solutions have been proposed. Remedies involving protecting or reinforcing the bolt receiving section of the door frame are well known. U.S. Pat. No. 4,005,890 to Murch provides a striker guard to be inserted along with the bolt receiver or striker plate.

Two prior art references, U.S. Pat. No. 4,074,484 to Queren and U.S. Pat. No. 3,918,207 to Aliotta both provide a plate guard for the striker. All three references recognize that when a burglar chooses the door as a means of entry, it has been commonplace to try to force entry by either kicking the door or using a crowbar at the point thatthe locking means engages the door and the frame. To combat this type of entry, all three references and particularly Queren and Aliotta rely on plate means to try to reinforce the door jamb itself. In Queren, a plate is inserted along the inside face of the frame at right angles to the striker plate. In Queren, the reinforcing plate runs at right angles to the opening on the striker plate, whereas in Aliotta the plate runs parallel. In each invention, a lip member is provided with the plate which rests at the frame edge. Thus, the Aliotta reference in fact is using an enlarged striker plate.

Unfortunately, none of these prior art proposals truly solves the problem. This is particularly true in the case of a burglar who uses a crowbar. When a crowbar is inserted at the lock portion of a door assembly employing any of the three aforementioned references, the thin lip of the plate is relied upon to take the first pressure of the prying wedge. The plate simply pops from the door jamb and the burglar, by splintering or wedging the door jamb, is able to pry the striker plate away from the bolt.

There is, therefore, a need for a means to reinforce the jamb member itself by increasing its sheer and tensile strength to make it less conducive to splintering.

SUMMARY OF THE INVENTION

The aforementioned prior art problems are solved by the door jamb reinforcing means of this invention. This invention contemplates reinforcing rods which are utilized with a brace plate and which are inserted into the door jamb internally along the face parallel to the striker plate to enhance the shear and tensile strength of the jamb itself.

The device of this invention is readily installable as a retrofit on already existing doors, as well as being capable of incorporation within an entirely new door assembly. The brace bar contemplated need be only as wide as the edge of the door jamb, and its length, while not crucial, preferably extends on either side of the bolt receiver for a distance of one or more inches. The brace bar, preferably steel, may be predrilled to allow insertion therein of one or more reinforcing rods. The reinforcing rods may be conveniently bolts and the length of the reinforcing rod or bolt must be such that it is sufficient to span the jamb for a distance at least exceeding that of the width of the bolt receiver itself. It is preferred that the length of the bolt be two-thirds the depth of the door frame.

The bolts may be secured by nuts, and if the device is retrofitted, then the jamb itself may be routed out to allow insertion therein and tightening of a nut at the bolt end. This nut provides the bearing area against any movement of the reinforcing rod or bolt. It will also be necessary to fill this hole with wood filler compound or other suitable filler if it is desirable to hide the hole.

It is therefore an object of this invention to provide a door jamb reinforcing means which overcomes prior art deficiencies by increasing the shear and tensile strength of the jamb itself.

It is yet another object of this invention to provide a door jamb reinforcer which is compatible with preexisting door jambs as well as being suitable for new construction.

It is yet another object of this invention to provide the aforementioned as an anti-burglar device which is simple in construction, easy to install, pleasing in appearance, easy to manufacture, durable and which will appeal to both professional carpenter and home owner alike.

These and other objects will be more readily ascertainable to one skilled in the art from a consideration of the drawings and exemplary embodiments.

BRIEF DESCRIPTION OF THE DRAWING(S)

FIG. 2 illustrates a side view, partially in phantom, of the preferred embodiment of this invention.

FIG. 3 illustrates a front or edge elevation of a door jamb with the invention installed.

FIG. 4 illustrates a top cross section looking down through a door jamb and door showing the invention in relation thereto.

FIGS. A and B show the same top cross sections looking down but with the prior art inventions illustrated to contrast the same with the preferred embodiment of this invention.

DETAILED DESCRIPTION OF THE PREFERRED EMBODIMENT(S)

Figure 1:
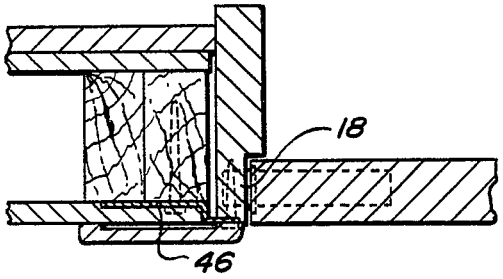
FIG. 1 shows an isometric view of a conventional door frame together with the preferred embodiment of the device of this invention in place.
Figure 1:
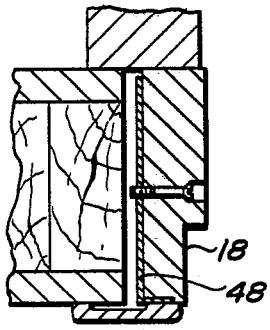
Figure 1:
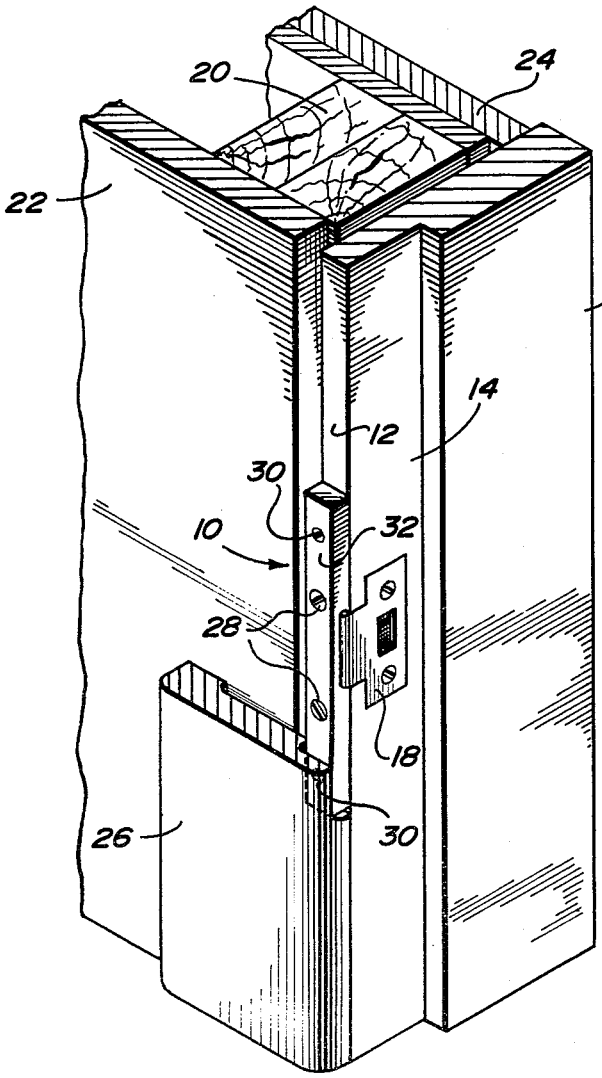

Referring now to the drawings and more particularly to FIG. 1, an isometric view of the preferred embodiment of the door jamb reinforcer, generally 10, is shown. The invention is shown installed, resting against edge 12 of jamb 14 of a door frame. Stop 16 is shown as an integral part of jamb 14, which is conventional with the "pre-hung" door frames comon in new construction today. It should be noted at this point that stop 16 in older construction is normally a separate piece distinct from jamb 14 and generally nailed in the position shown in FIG. 1. The view in FIG. 1 also shows clearly bolt receiver 18, which in the view shown is a striker plate.

Other parts of a common door frame such as studs 20, outside frame member 22 and inside frame member 24 are shown. Trim 26 is shown in cutaway to illustrate that a trim member may optionally be used to cover door jamb reinforcer 10.

With particular reference to door jamb reinforcer 10 as shown in FIG. 1, the end of reinforcing rods 28 are visible as well as screws 30 which are used to hold brace bar 32 firmly in place on jamb edge 12.

Referring now to FIG. 2, a side view of jamb 14 is shown with the door jamb reinforcer of this invention partially in phantom. Brace bar 32 is shown in side view as is also the case with striker plate 18. Screws 30 referred to in the previous drawing are shown in phantom. More importantly, reinforcing rods 28 are shown here to better illustrate their length and function in relationship to bolt receiver or striker plate 18. It can be noted in FIG. 2 that reinforcing rods 28 exceed in length the width of striker plate 18 and continue for some distance internally within jamb 14. Reinforcing rods 28 are preferably bolts as shown in FIG. 2, ending with threaded ends 34 on which nuts 36 are mounted. Jamb 14 also includes aperatures 38 necessary to receive and accommodate nuts 36 and provide for their tightening.

Referring now to FIG. 3, a front elevation of brace bar 32 is shown. This is the view which would be presented to an onlooker when the door is closed. This view is also useful to illustrate that the area directly behind brace bar 32 and which extends deeply into the door jamb is the area of the jamb which is reinforced by this invention. It would be impossible to insert a crowbar on either of the sides of reinforcing rod 28 and successfully pry the door open. This is because, in lieu of a plate protector, this device genuinely reinforces the jamb itself.

Referring now to FIG. 4, a cross section taken through the top of the door frame looking down is shown. In this view, door 40 including lock 42 and with it bolt 44 are also illustrated. Again, the reinforcing aspects of this invention are visible. Note the relationship of reinforcing rods 28 and brace plate 32 in relationship to jamb 14, which is thereby reinforced at bolt 44.

With reference to FIG. 4, and to illustrate the novelty and unobviousness aspects over the prior art, reference is made to prior art FIG. A which is the same view as that of FIG. 4 only showing a prior art reinforcing plate such as that illustrated in the Queren reference. In prior art A, plate 46 is shown as a V-shaped plate at generally right angles to striker plate 18. In prior art B which is similar to the Aliotta reference, plate 48 is shown running in the same plane parallel to striker plate 18. Note, however, that prior art B, even though the longitudinal direction of reinforcing plate 48 is the same as the instant invention, the plate is on the outside of jamb 14, in which position it would not resist a prying motion, but would instead pop off, or in the alternative, remain in place but not prevent the splintering of jamb 14.

Having now described and illustrated my invention, it is not intended that such description limit the scope of-this invention, but rather that this invention be limited only by reasonable interpretation of the appended claims.

What is claimed is:

1. In a door frame, including, generally, a door jamb including a stop attached to an upright stud, and a striker plate or other bolt receiver means on said jamb, jamb reinforcing means comprising:

(a) a rigid brace bar located longitudinally proximate the edge of said jamb adjacent said bolt receiver; and (b) at least two reinforcing rods positioned through said brace bar transversely into said jamb at a generally right angle thereto, said rods being of a length sufficient to span said jamb for a distance about at least two thirds the depth of the door frame; and, (c) nuts, one each mounted on said interior rod ends.

* * * * *